US006554080B2

(12) United States Patent
Horner

(10) Patent No.: US 6,554,080 B2
(45) Date of Patent: Apr. 29, 2003

(54) MOTOR GRADER HAVING MATERIAL DISTRIBUTION ATTACHMENT

(75) Inventor: Dale R. Horner, Aurora, MO (US)

(73) Assignee: Horner Grade Contracting, Inc., Aurora, MO (US)

( * ) Notice: Subject to any disclaimer, the term of this patent is extended or adjusted under 35 U.S.C. 154(b) by 0 days.

(21) Appl. No.: 09/897,509

(22) Filed: Jun. 29, 2001

(65) Prior Publication Data

US 2003/0000714 A1 Jan. 2, 2003

(51) Int. Cl.[7] ..... E01C 11/28; E02F 3/12
(52) U.S. Cl. ..... 172/785; 172/181; 404/98
(58) Field of Search ..... 37/142.5, 34–37; 404/98, 84, 90; 172/781, 782, 783, 784, 785, 788, 169, 195, 200; 414/685, 697

(56) References Cited

U.S. PATENT DOCUMENTS

| | | | | |
|---|---|---|---|---|
| 2,068,433 A | * | 1/1937 | Peterson | 172/785 |
| 2,794,274 A | * | 6/1957 | Robinson | 172/782 |
| 3,319,366 A | * | 5/1967 | Thompson | 37/142.5 |
| 4,060,136 A | | 11/1977 | Hendrickson et al. | |
| 4,074,767 A | | 2/1978 | Cole | |
| 4,084,643 A | | 4/1978 | Easterling | |
| 4,105,078 A | | 8/1978 | Gilbert | |
| 4,197,032 A | * | 4/1980 | Miller | 172/108 |
| 4,848,012 A | * | 7/1989 | Zimmerman | 172/784 |
| 6,068,065 A | | 5/2000 | Mehew et al. | |

OTHER PUBLICATIONS

Construction Equipment Attachment & Custom Engineering Guide 11th Edition—John Deere—Copy of Front Cover, pp. i, 27, 29 and back cover—1998.

* cited by examiner

*Primary Examiner*—Robert E. Pezzuto
(74) *Attorney, Agent, or Firm*—Hovey Williams LLP

(57) ABSTRACT

A motor grader can be adapted for laying down a layer of granular material such as base rock or cold mix asphalt by mounting a dispensing hopper attachment onto the front of the motor grader and a spreading and leveling screed onto the moldboard. As the motor grader advances, it pushes a dump truck that continuously loads materials into the hopper. Those materials are in turn continuously discharged at a metered rate of flow through the bottom of the hopper and onto the roadbed. The resulting swath of materials passes between the front wheels of the grader as the grader continues to advance, whereupon the screed engages the swath and spreads the materials in opposite lateral directions while leveling them to the desired depth. The screed has swept-back wings that may be extended as necessary to adjust the overall width of the screed, and outboard shields on the outermost ends of the wings confine the spread materials to the roadbed and prevent their accidental discharge into ditches and the like alongside the roadbed. The crown of the deposited layer can be varied by tipping the nose of the screed upwardly or downwardly to the extent necessary or desired.

17 Claims, 5 Drawing Sheets

MOTOR GRADER HAVING MATERIAL DISTRIBUTION ATTACHMENT

TECHNICAL FIELD

This invention relates to the field of motor graders and, more particularly, to an attachment that adapts such machines for laying down, in one pass, a finished layer of aggregate material such as base rock or cold mix asphalt onto roads, streets, parking lots or driveways.

BACKGROUND

The known method of laying down base rock or cold mix asphalt involves a two-step operation in which the material is first dumped from a truck onto the ground or roadbed. A motor grader then comes along and spreads the material back and forth using its moldboard until the material is at the desired depth, width and slope. Typically, excess material slips into ditches on either side of the roadbed and is wasted. Significant, time-consuming working and reworking of the material may be necessary in order to achieve the desired depth, width and crown of the roadbed, which not only slows the overall process but also increases the likelihood of wasting significant amounts of material. Moreover, excessive handling and manipulation of base rock material can result in the limestone fines becoming separated from the aggregate and settling to the bottom of the layer, detracting from their ability to solidify when wet and hold the aggregate in a solid matrix that provides a better roadbed. Generally speaking, the less handling the better when laying down gravel material.

SUMMARY OF THE INVENTION

The present invention converts a motor grader into a machine that is capable of laying down in one pass a finished layer of aggregate material such as base rock or asphalt that has the desired thickness, width and profile of the finished product. By laying down the finished product on-the-go in a one-pass operation, significant time and labor savings can be achieved, as well as better control. Furthermore, less handling means a better quality roadbed where base rock is the material being deposited.

The present invention contemplates attaching a special distribution hopper to the front end of the motor grader ahead of the front wheels and a special screed to the moldboard behind the front wheels. As the motor grader advances, the hopper continuously receives material from a dump truck being pushed along the roadbed ahead of the grader by the hopper, and such material is continuously metered out onto the roadbed or other surface to form a swath located between the front wheels. The discharged swath of materials is then acted upon by the trailing screed, which skims off excess material from the top of the swath and spreads it laterally outwardly in opposite directions to produce a layer that is wider than the front wheels. Outermost shields at opposite left and right ends of the screed limit the width of the outwardly spreading materials to prevent spillage into ditches alongside the roadbed. The screed is mounted on the front side of the moldboard so as to be in a position to engage and work the materials instead of the moldboard. However, since the moldboard is adjustable in a variety of directions through various hydraulic actuators on the grader, manipulation and adjustment of the moldboard by the actuators can be used to correspondingly adjust the screed. Because the screed is pointed with a pair of diverging wings, adjustment of the nose of the screed upwardly or downwardly relative to the rear ends of the wings results in changes in the shape of the crown that is on the layer of materials being deposited and spread. In one preferred embodiment of the invention, such crown can range from a six inch negative crown to a flat or level crown and to a six inch positive crown at the other extreme.

The two wings of the screed can be extended and retracted hydraulically from the seat of the motor grader so as to correspondingly adjust the width of the material being laid down. The discharge outlet at the bottom of the distribution hopper has of a pair of side-by-side metering gates that can be independently adjusted so as to correspondingly vary the rate of discharge from the hopper. An operator's platform is provided on the backside of the distribution hopper to enable an extra worker to ride the machine at that location and operate controls for the metering gates as he observes loading and discharging of the hopper. A rotary agitator inside the hopper helps assure an orderly and even discharge flow from the hopper.

DETAILED DESCRIPTION

Figure 1:
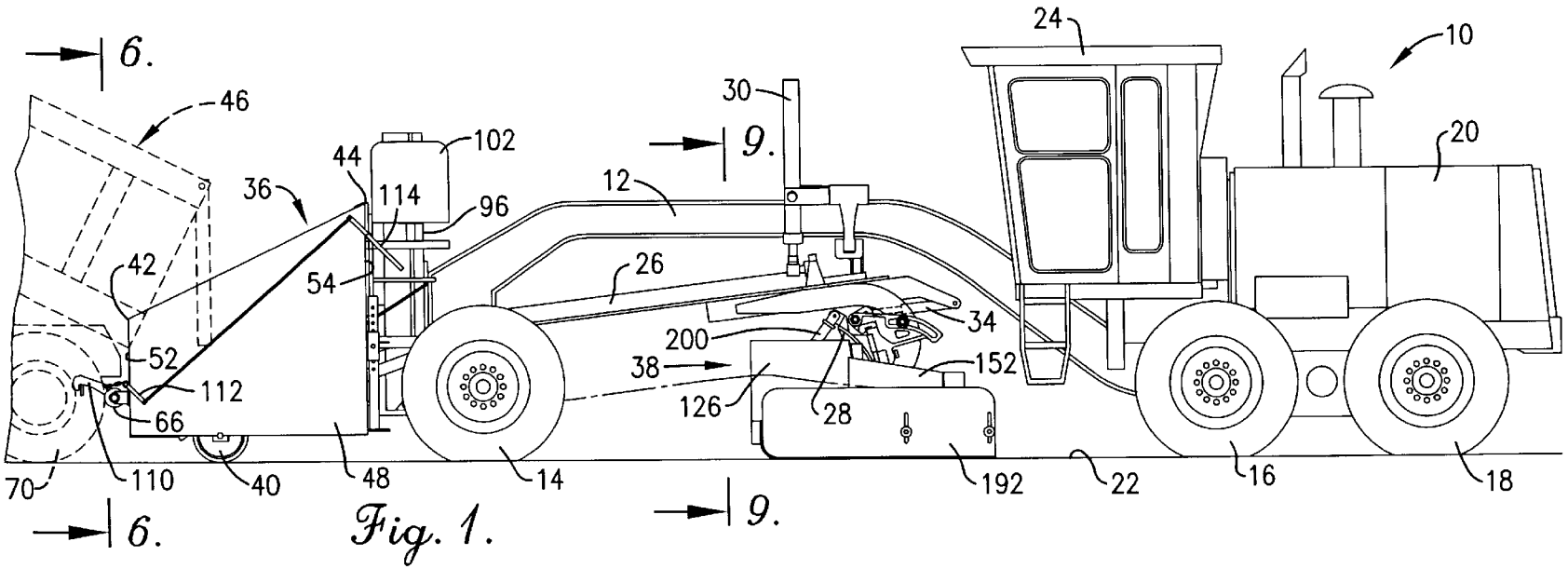
FIG. 1 is a side elevational view of a motor grader provided with material distribution apparatus in accordance with the principles of the present invention, a dump truck being illustrated fragmentarily and in phantom at the front end of the apparatus.

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

Referring to the figures, a motor grader is shown generally at 10 and includes a wheeled chassis 12 having a pair of laterally spaced front wheels 14 and two pairs of laterally spaced rear wheels 16 and 18. An engine 20 drives rear wheels 16,18 to propel the motor grader along a roadbed 22 or other ground surface, and an operator cab 24 is supported on chassis 12 just ahead of engine 20.

As well understood by those skilled in the art, a fore-and-aft drawbar 26 is attached to the front of the chassis 12 by a ball joint or the like (not shown). Drawbar 26 extends rearwardly from the front ball joint and underneath the upwardly arched chassis 12 to support a blade or moldboard 28 that can be adjusted in a number of different directions to assume a variety of adjusted positions. In this regard, as is conventional, moldboard 28 can be adjusted upwardly and downwardly by a pair of left and right lift cylinders 30 and 32, each of which can be independently operated so as to change the left-to-right tilt of moldboard 28. A side shift cylinder (not shown) enables moldboard 28 to be shifted laterally to the left or right relative to drawbar 26, and a fore-and-aft tilt cylinder 34 (FIG. 1) is coupled to moldboard 28 in such a manner that moldboard 28 can be tipped forwardly or rearwardly about a lower transverse axis to adjust its angle of attack relative to the ground. Moldboard 28 can also be rotated about a vertical axis by means not shown to place moldboard 28 in an oblique attitude relative to the direction of travel of the motor grader, although in connection with the present invention moldboard 28 will normally be perpendicular to the path of travel as illustrated in the plan view of FIG. 2.

In connection with the present invention, motor grader 10 is provided with a material distribution attachment comprising two primary components, i.e., a distribution hopper 36 at the front of the machine and a screed 38 attached to moldboard 28 in the middle of the machine. Dealing first with hopper 36, it will be seen that such structure generally comprises an open top receptacle having a set of ground engaging wheels 40. The upper front edge 42 of hopper 36 is lower than the upper rear edge 44 thereof so as to facilitate loading of hopper 36 with granular materials from a dump truck 46 during operation as illustrated in FIG. 1 and as will subsequently be explained in more detail. The exterior of hopper 36 includes a pair of opposite, left and right sidewalls 48 and 50 respectively, an upright exterior front wall 52, and an upright rear wall 54 that begins at the upper rear edge 44 and extends part way down the back of hopper 36. A sloping bottom wall 56 extends downwardly and forwardly from the lower extremity of rear wall 54 generally toward front wall 52 but terminates a short distance rearwardly from front wall 52. A horizontal, relatively short lowermost wall 58 interconnects the lower extremity of front wall 52 and the forward extremity of bottom wall 56.

Inside hopper 36, a downwardly and rearwardly sloping interior front wall 60 extends from a point part way up exterior front wall 52 down to the forward extremity of bottom wall 56. A pair of downwardly and inwardly sloping interior sidewalls 62 and 64 converge toward the center of the hopper and intersect bottom wall 56 and the front interior wall 60. Front wall 52 carries a pair of horizontal rollers 66 that bear against the rear tires 70 of dump truck 46 during operation as illustrated in FIG. 1.

Figure 2:
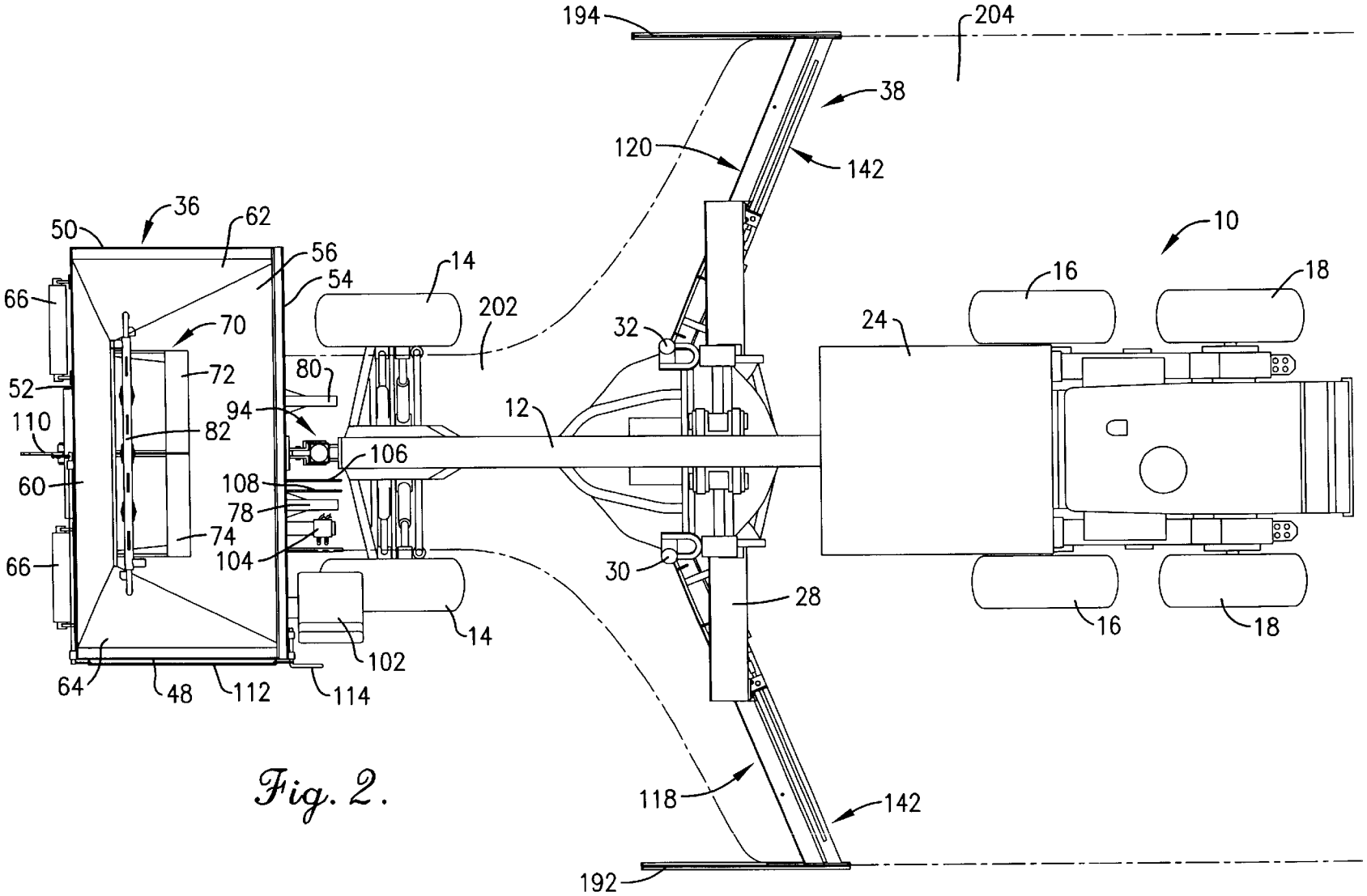
FIG. 2 is a top plan view thereof illustrating the manner in which materials are discharged from the metering hopper and are then spread out to the desired width by the trailing screed, the screed being shown with its wing portions fully extended.
Figure 6:
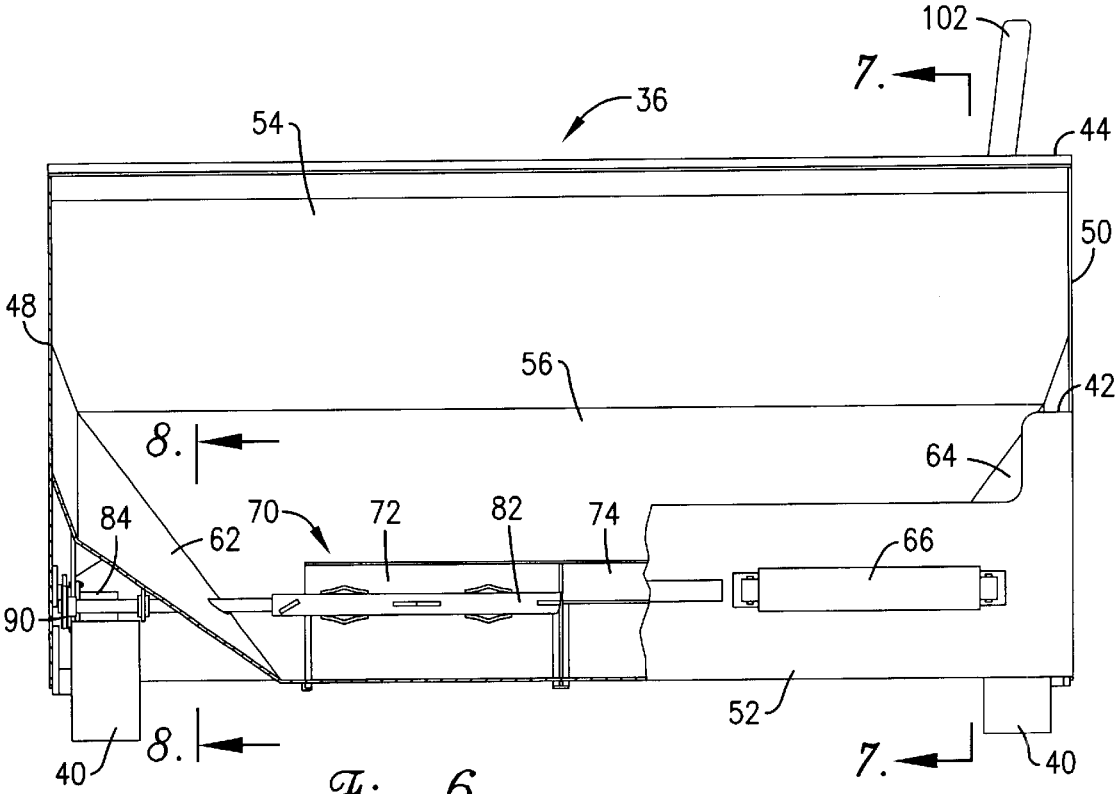
FIG. 6 is a front elevational view of the distribution hopper taken substantially along line 6—6 of FIG. 1 with the front wall broken away to reveal details of construction.
Figure 7:
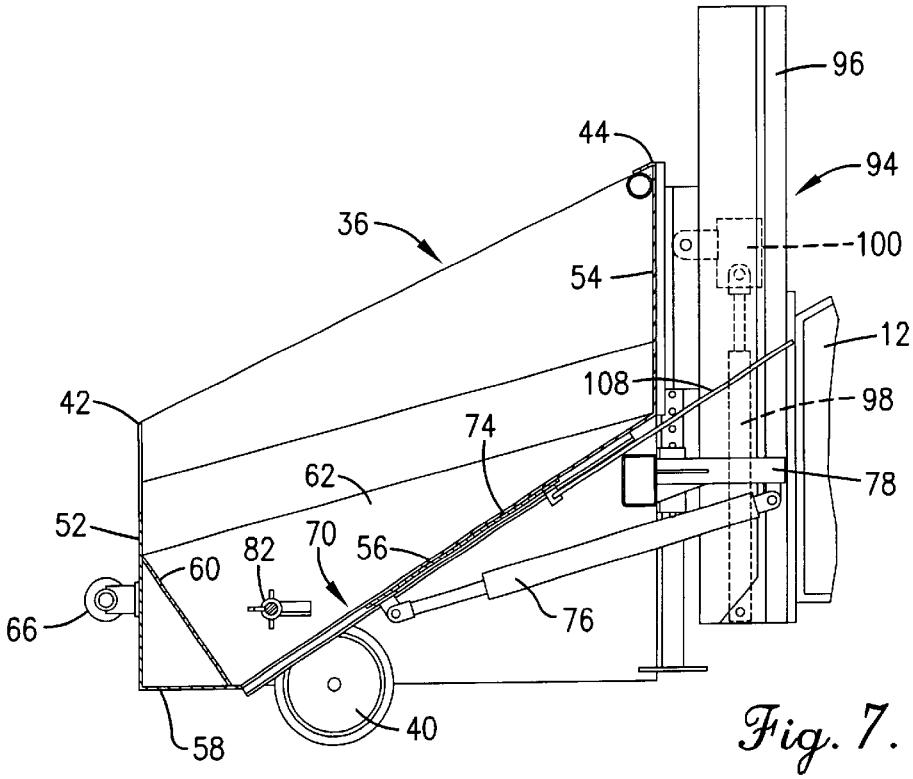
FIG. 7 is a vertical cross-sectional view through the distribution hopper taken substantially along line 7—7 of FIG. 6.

The discharge outlet of hopper 36 is broadly denoted by the numeral 70 and is located in bottom wall 56 adjacent the intersection with front interior wall 60. Outlet 70 is controlled by a pair of side-by-side metering gates 72 and 74 that are independently shiftable along inclined paths of travel parallel to bottom wall 56 between positions opening and closing respective left and right halves of outlet 70. In FIGS. 2,6 and 7, gates 72 and 74 are shown in their open position. A pair of independently operable hydraulic piston and cylinder assemblies 76 (only one being illustrated; see FIG. 7) actuate gates 72,74 between their open and closed positions, the rear ends of the cylinders 76 being attached to rearwardly projecting, horizontally disposed mounts 78 and 80 on the rear of hopper 36 (FIGS. 2 and 7).

Figures 3, 3A, 8:
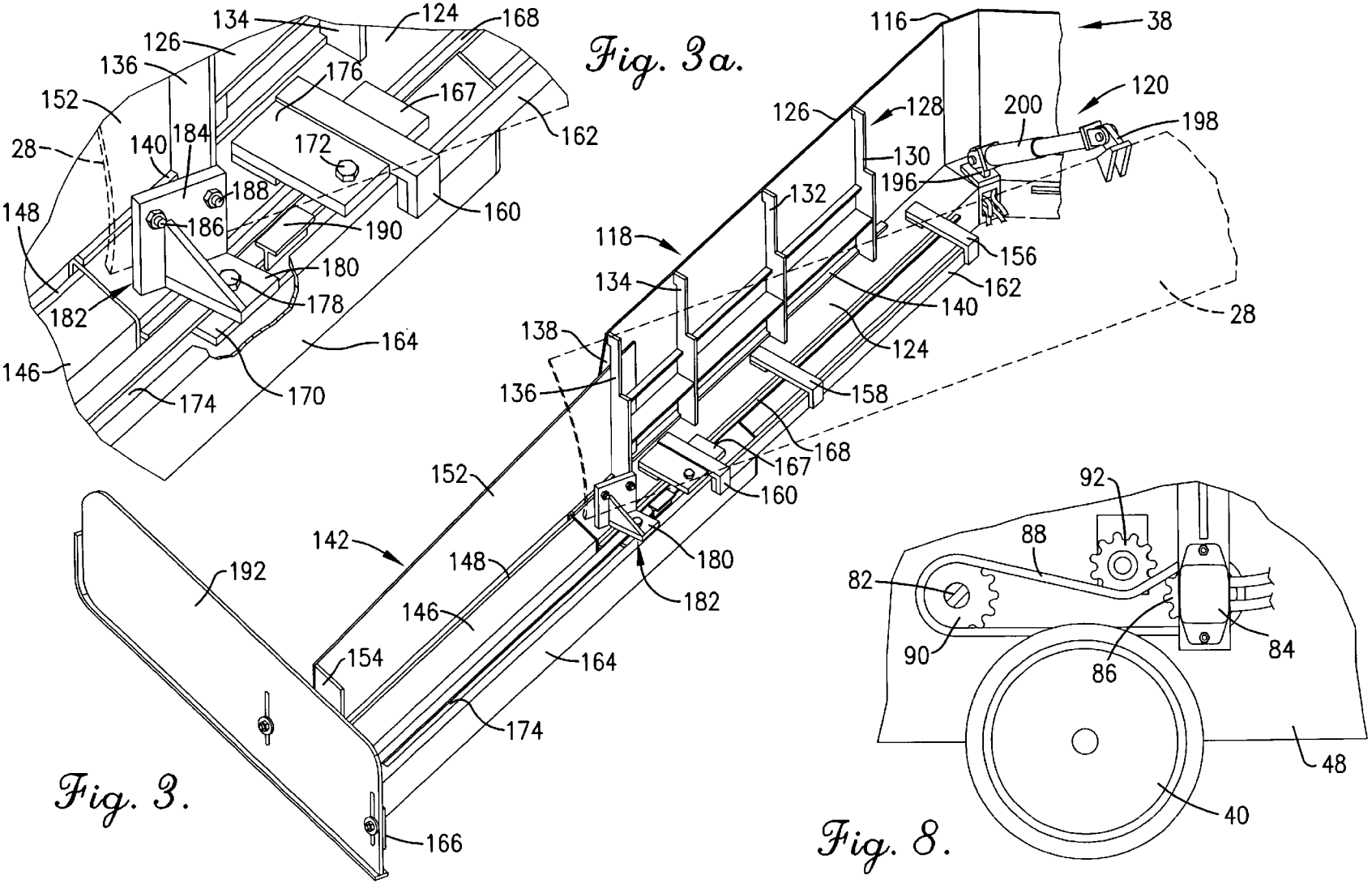
FIG. 3 is an enlarged, fragmentary rear perspective view of the left wing of the screed in its extended condition, illustrating details of construction and showing the moldboard in broken lines.
FIG. 3*a* is a fragmentary, further enlarged view of the structure shown in FIG. 3.
FIG. 8 is a further enlarged fragmentary cross-sectional view through one portion of the distribution hopper taken substantially along line 8—8 of FIG. 6 and with a sloping internal sidewall of the hopper removed to reveal details of construction of the drive mechanism for the agitating rotor of the hopper.

A transverse agitating rotor 82 spans outlet 72 a short distance thereabove for the purpose of keeping materials agitated and loose near the bottom of hopper 36 to facilitate their discharge through outlet 70. Opposite ends of rotor 82 pass through interior sidewalls 62 and 64 for ultimate rotational support by suitable bearings located behind such interior walls. The drive for rotor 82 is located outboard of interior sidewall 62 and inboard of outer sidewall 48 as illustrated in FIGS. 6 and 8. Such drive includes a hydraulic motor 84 (FIG. 8) having an output shaft (not shown) that carries a sprocket 86. An endless chain 88 is entrained around sprocket 86 and around a second sprocket 90 that is fixed to the outboard end of rotor 82. An adjustable idler sprocket 92 engages the slack side of chain 88 to maintain tension in the chain.

Hopper 36 is attached to the front end of chassis 12 by mounting apparatus broadly denoted by the numeral 94. Apparatus 94 comprises a centrally disposed, upright tower or mast 96 that is fixedly secured to the chassis 12 by suitable means such as bolts (not shown). An upright hydraulic cylinder 98 (FIG. 7) within mast 96 is operably coupled with the upper backside of hopper 36 via suitable coupling means broadly denoted by the numeral 100 so that extension and retraction of cylinder 98 causes hopper 36 to be raised and lowered relative to mast 96. It is contemplated that during normal working operations, hopper 36 will be fully lowered so that ground wheels 40 are touching the ground and supporting the load of hopper 36 and its contents. On the other hand, for transport purposes between job sites, hopper 36 may be elevated along mast 96 and supported in a raised, transport position (not shown).

An operator seat 102 is attached to the backside of hopper 36 near the left end thereof and at such a height that an operator stationed at seat 102 can observe both loading of hopper 36 and discharging of material from the hopper. A set of controls 104 (FIG. 2) are easily accessible to the operator positioned on seat 102, such controls 104 being operably connected to gate cylinders 76 so that the operator may regulate the positions of gates 72 and 74. The lift cylinder 98 which raises and lowers hopper 36 is controlled by a suitable control (not shown) located in cab 24. A pair of upwardly and rearwardly projecting indicator rods 106 and 108 are fixed to respective doors 72 and 74 to provide a visual indication for the operator at seat 102 of the position of gates 72,74, which can be important when outlet 70 is covered by material within hopper 36. It will be noted from FIG. 2 in particular that outlet 70 is slightly narrower than the width of the space between front wheels 14 such that material discharged through outlet 70 forms what may be termed a ribbon or swath of material having a width no greater than the space between the wheels. Because outlet 70 is centered between wheels 14, the wheels become disposed on opposite sides of the material swath during discharging and spreading operation.

A hook 110 at the front end of hopper 36 (FIGS. 1 and 2) may be used to detachably secure the truck 46 to the front end of hopper 36. Hook 110 is operated manually by a linkage 112 that runs across the hopper 36 and up the left side thereof outboard of left sidewall 48. Linkage 112 terminates at its upper end in an operating handle 114 positioned for actuation by the operator stationed on seat 102.

The screed 38 is generally V-shaped in overall configuration when viewed in plan, presenting a pointed body having a nose 116 and a pair of oppositely extending, swept-back, left and right wings 118 and 120. Generally speaking, the wings 118 and 120 present a forwardly pointed lower screeding edge 122 (FIG. 5) that determines the thickness or depth of the layer of materials formed by the screed. Each of the wings 118,120 has as its primary component a tubular, square in cross-section beam 124 that is joined at its inner end with the beam 124 of the other wing. An upright panel or wall 126 is secured to and extends along the front of each beam 124 to prevent material from flowing up and over the top edge of the beam during operation. Wall 26 is secured to beam 124 by a fence 128 that includes four uprights 130, 132, 134 and 136. Each of the uprights 130–136 is securely affixed at its upper end to wall 126 but is spaced slightly rearwardly from such wall below the point of attachment so as to define a transverse slot 138 between fence 128 and the backside of wall 126 for a purpose yet-to-be-explained. A slide strip 140 is fixed to the top surface of beam 124 along the front edge thereof and is generally co-extensive in length with fence 128.

Figure 5:
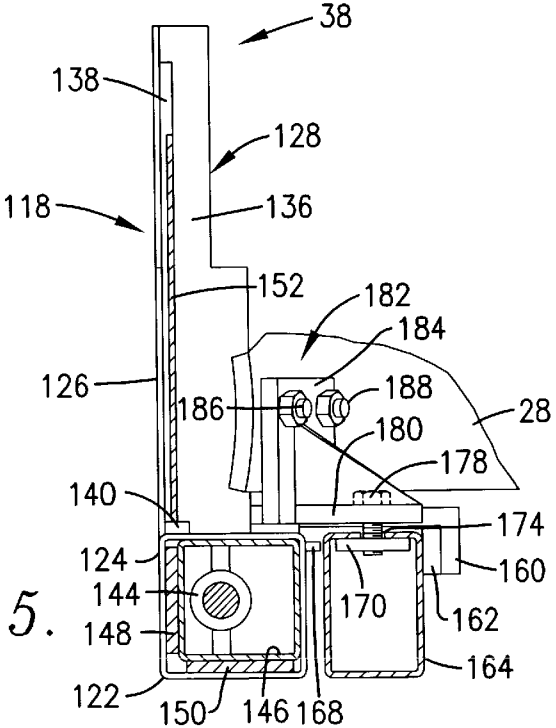
FIG. 5 is a fragmentary transverse cross-sectional view through the screed taken substantially along line 5—5 of FIG. 4.

Each wing 118,120 is adjustably extendable and retractable to vary its effective length, thus adjusting the overall width of screed 38. In this regard, each wing 118,120 includes an extendable and retractable wing tip 142 that is shifted in or out by a hydraulic cylinder 144 housed within beam 124. Each wing 142 is formed in part by a second tubular beam 146 that is of rectangular cross-section and has slightly smaller dimensions than main beam 124. Thus, wing tip beam 146 is telescopically received within main beam 124 and is guided in its telescoping reciprocation by a pair of spacer plates 148 and 150 (FIG. 5) fixed to front and bottom walls of main beam 124 respectively (FIGS. 3, 3*a* and 5).

Each wing tip beam 146 has its own front wall extension 152 that is received within horizontal slot 138 between fence 128 and front wall 126. The lower edge of front wall extension 152 rides upon slide strip 140 on main wing beam 124. Each front wall extension 152 is welded at its outer vertical edge to an upright member 154 that is in turn welded along its bottom edge to the wing tip beam 146.

Each main beam 124 has three generally L-shaped brackets 156,158 and 160 welded to the top surface thereof and projecting rearwardly therefrom at spaced locations therealong. The downturned outer legs of brackets 156, 158 and 160 support a guide strap 162 that extends parallel to main beam 124 in rearwardly spaced relation thereto. Guide strap 162 bears against and reciprocably guides a trailing tubular, rectangular in cross-section wing tip beam 164 that is spaced slightly behind and extends parallel to the first wing tip beam 146. As illustrated in FIG. 5, trailing wing tip beam 164 projects downwardly below the level of wing tip beam 146 to the same extent as the main beam 124. Thus, even though the lower extremity of the front wing tip beam 146 is not quite as low to the ground as main beam 124, this difference is made up for by the trailing wing tip beam 164 such that, in effect, the lower front edge 122 of screed 38 is at the same level along the full length of the wing from the inner end to the outer end thereof, even when the wing tip 142 is fully extended.

Figure 4:
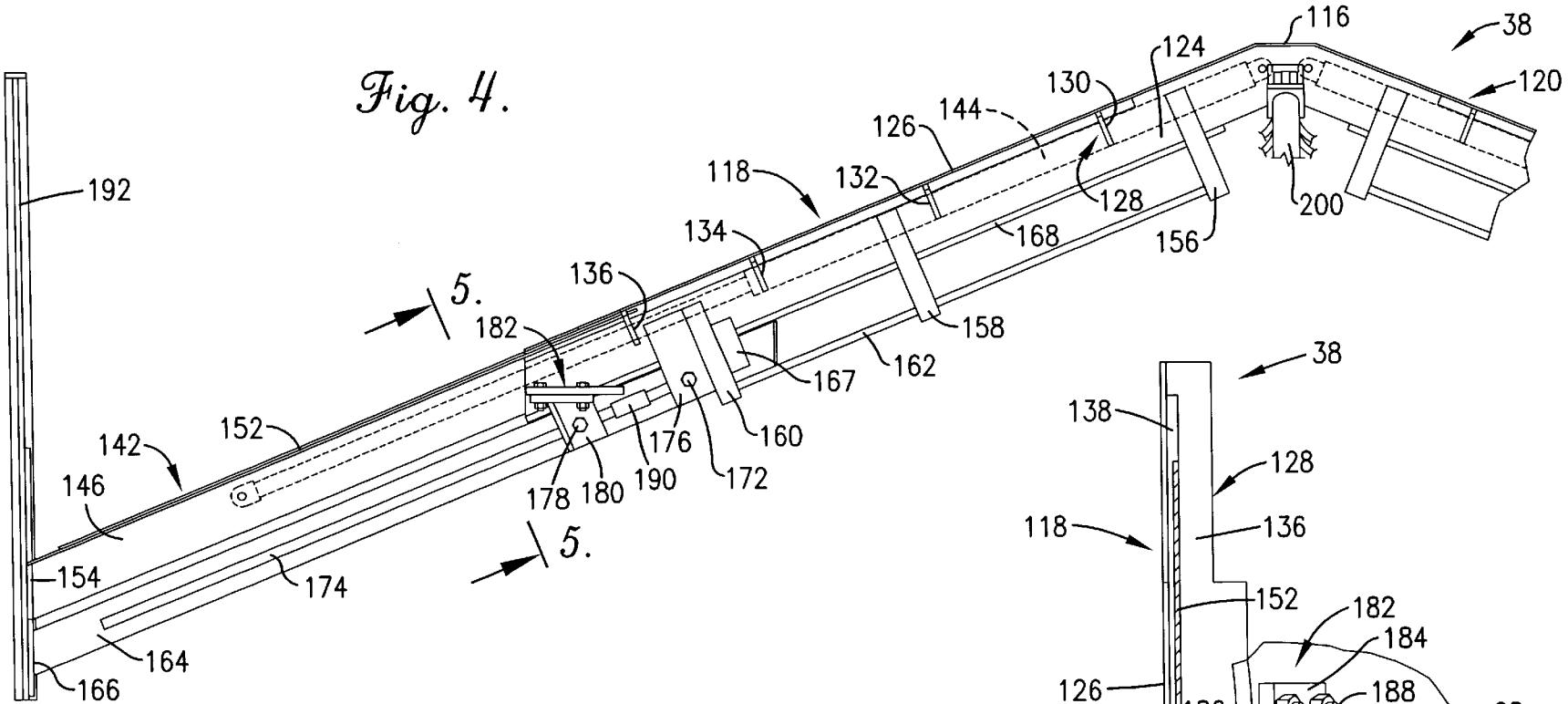
FIG. 4 is a fragmentary top plan view of the screed in its extended condition corresponding to the rear perspective view of FIG. 3.

The trailing wing tip beam 164 is fixed at its outer end to the front wing tip beam 146 via a fore-and-aft extending plate 166 (FIGS. 3, 3*a* and 4) that spans the outer ends of beams 146 and 164 and is welded thereto and to the upright member 154. At its inner end the trailing wing tip beam 164 has a rectangular lug 167 welded thereto that projects forwardly into overlying relationship with the top surface of main beam 124, for the purpose of helping to support and guide trailing wing tip beam 164 during its extension and retraction. A long guide strip 168 is welded to the rear face of main beam 124 and bears against the front face of trailing wing tip beam 164 during adjusting reciprocation of the latter. Thus, during such adjusting movement of trailing wing tip beam 164, the beam is trapped between rearwardly disposed guide strap 162 on the one hand and forwardly disposed guide strip 168 on the other.

Trailing wing tip beam 164 is also supported by a relatively short rectangular plate 170 that is housed within trailing wing tip beam 164 and bears against the upper inside surface of the top wall of such beam. At its inboard end, plate 170 is supported by an upright bolt 172 that passes through a slot 174 in the top wall of trailing wing tip beam 164. Bolt 172 is suspended from the rear end of a support plate 176 that is fixed at its front end to the upper surface of main wing beam 124. At its outboard end the plate 170 is supported by an upright bolt 178 that hangs from the rearwardly extending, horizontal leg 180 of a generally L-shaped mounting bracket 182 having an upright leg 184 that is attached to the lower rear extremity of moldboard 28 via attaching bolts 186 and 188. Mounting bracket 182 is not fixed to but instead merely overlies main beam 124. Support plate 178 has an upstanding handle 190 of generally T-shaped configuration that projects upwardly through slot 174 in trailing wing beam 164. The head of handle 190 is wider than slot 174 such that when bolts 172 and 178 are removed, support plate 170 cannot fall to the inside bottom surface of trailing wing tip beam 164 and become inaccessible. In addition to this keeping or retaining function, the head of handle 190 is also adapted to be grasped manually during assembly and disassembly operations.

The outermost ends of wings 118 and 120 are provided with upright shields 192 and 194 respectively that confine the material as it is being leveled and spread laterally by screed 38. Each of the shields 192,194 is bolted to the fore-and-aft plate 166 of wing tip 142 and projects forwardly a substantial distance therefrom. Each shield 192,194 can be height adjusted by virtue of a slotted relationship with the bolts that secure the shield to plate 166.

The two mounting brackets 182 at opposite ends of moldboard 28 serve as components of mounting structure that secure the screed 38 to moldboard 28. In addition to brackets 182, such mounting structure also includes an upstanding lug 196 on screed 38 at nose 116, a corresponding lug 198 fixed to the backside of moldboard 28 at the lateral center thereof near its top edge, and a rigid link 200 pivotally connected at its opposite ends to lugs 196 and 198. Screed 38 is thus securely attached to moldboard 28 and is held against significant movement relative thereto. However, by virtue of the various hydraulic cylinders that adjust moldboard 28, screed 38 can likewise be adjusted.

Operation

Operation and use of the distribution attachment in accordance with the present invention should be apparent from the foregoing description. With particular reference to FIGS. 1 and 2, however, a brief further description of the operation is in order.

During use, one operator is positioned within cab 24 and a second operator is positioned at seat 102. The operator in cab 24 controls forward motion of grader 10, as well as lifting and lowering of hopper 36, extension and retraction of wings 118,120, up and down adjustment of screed 38, and fore-and-aft tilting of screed 38 for controlling the crown applied to the material, if any. Depending upon the depth of the layer of material to be placed on roadbed 22, screed 38 will be adjusted closer to or further above the roadbed. A corresponding adjustment of side shields 192 and 194 may be necessary to assure that the lower edges thereof are engaging and riding along roadbed 22 during forward movement of the grader.

A dump truck 46 is backed up to the grader until its tires 70 come into abutting engagement with rollers 66 on the front of hopper 36, which has previously been lowered sufficiently to place its wheels 40 in contacting engagement with roadbed 22. As the bed of truck 46 is raised as illustrated in FIG. 1, material is discharged from the bed into and through the open top of hopper 36 where it begins to issue from discharge outlet 70. As the grader is then advanced, the grader pushes truck 46 along with it so that the contents of the truck are continuously discharged into the awaiting hopper 36 at a rate determined by the tilt angle of the truck bed.

The operator situated on seat 102 observes the ongoing process and adjusts gates 72 and 74 as may be necessary or desirable to suitably regulate the flow of material as it emanates out of the bottom of hopper 36. As illustrated in FIG. 2, such discharged material forms a swath 202 that is disposed between front wheels 14 of the grader, due to the central location of outlet 70 and the fact that it is no wider than the distance between such front wheels.

As the screed 38 then engages the discharged swath 202, the top portion of the swath is skimmed off and deflected laterally outwardly in opposite directions due to the swept back nature of wings 118 and 120 of screed 38. Swath 202 is thus widened out and leveled down to produce in one pass a final layer 204 behind screed 38 having a width determined by the outboard shields 192 and 194.

This process of unloading materials from truck 46, metering them out of hopper 36, and spreading them with screed 38 continues on an ongoing, non-stop basis until the truck is empty. At that time, forward motion of the grader is halted, and the truck pulls away to obtain a new supply of material, during which time the next loaded truck maybe backed into position at the front of hopper 36. Once the next truck is properly positioned, the grader begins to advance again, continuing the process that was temporarily halted when the previous truck became empty.

In many instances there will be no need to engage the retaining hook 110 with the truck. However, where the roadbed or other surface is sloping down hill, it may be advisable to secure the hook 110 onto the truck to assure maintenance of the proper relationship between the truck and hopper 36.

Figure 9:
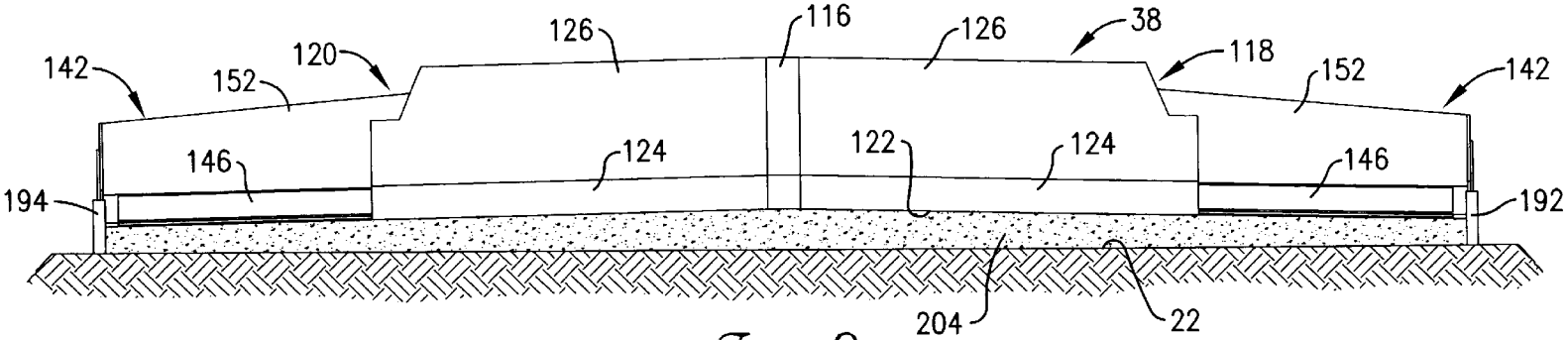
FIG. 9 is a schematic front elevational view of the screed in operation illustrating the manner in which a positive crown may be imparted to the material being laid down on the roadbed, such view being taken substantially along line 9—9 of FIG. 1.

FIG. 9 illustrates one example of a crown that can be imparted to the layer of materials 204 on roadbed 22. By cocking up screed 38 to a slight extent at its leading extremity, the nose 116 of screed 38 will be slightly higher than the outer ends of its wings 118,120. Consequently, layer 204 will be provided with a positive crown that is somewhat higher in the center than at its outer ends, and there will be a gentle slope in opposite left and right directions from the central crown. In one preferred embodiment, the crown can be varied between a six-inch negative crown and six-inch positive crown. Of course, layer 204 can also be configured to have essentially no crown at all and to instead be essentially perfectly flat from one lateral extremity to the other. It is also contemplated that the wings 118 and 120 maybe extended to such an extent that the overall width of screed 38 can be varied from twelve feet to twenty feet.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor(s) hereby state(s) his/their intent to rely on the Doctrine of Equivalents to determine and assess the reasonably fair scope of his/their invention as pertains to any apparatus not materially departing from but outside the literal scope of the invention as set out in the following claims.

What is claimed is:

1. In combination with a motor grader having a wheeled chassis provided with front wheels, material distribution apparatus comprising:

a dispensing hopper mounted on the chassis ahead of said front wheels for receiving a supply of materials and discharging them in a metered flow onto the ground as the grader advances; and a screed mounted on the chassis behind the front wheels and the hopper for spreading discharged materials into a layer having a desired thickness as additional materials are being discharged.

2. The combination as claimed in claim 1, said screed being mounted for up and down adjusting movement relative to the chassis.

3. The combination as claimed in claim 2, said motor grader having a moldboard adjustably supported on the chassis behind the front wheels for up and down adjusting movement and for changing the fore-and-aft tilt of the moldboard, said screed being mounted on the moldboard.

4. The combination as claimed in claim 3, said screed including a forwardly pointed lower edge comprising a pair of left and right, forwardly converging edge portions.

5. The combination as claimed in claim 4, said screed further including a forwardly pointed, generally upright front wall projecting upwardly from said lower edge and comprising a pair of left and right, forwardly converging wall portions.

6. The combination as claimed in claim 5, said screed further including a pair of left and right, extendible wing tips at opposite, left and right, outer ends of the screed.

7. The combination as claimed in claim 6, each of said wing tips having a hydraulic piston and cylinder assembly operably coupled therewith to permit remote operation of the wing tips.

8. The combination as claimed in claim 1, said screed including a pair of left and right, extendible wing sections at opposite, left and right, outer ends of the screed.

9. The combination as claimed in claim 1, said screed including a forwardly pointed lower edge comprising a pair of left and right, forwardly converging edge portions.

10. The combination as claimed in claim 9, said screed further including a forwardly pointed, generally upright front wall projecting upwardly from said lower edge and comprising a pair of left and right, forwardly converging wall portions.

11. The combination as claimed in claim 1, said hopper being configured to discharge materials between the front wheels, said screed being configured to spread the discharged materials laterally outwardly beyond the front wheels.

12. The combination as claimed in claim 11, said hopper having an outlet provided with a pair of left and right metering gates through which material is discharged from the hopper, each of said metering gates being adjustable for varying the rate of discharge.

13. The combination as claimed in claim 12, each of said gates being operably coupled with a hydraulic piston and cylinder assembly for remote adjustment.

14. The combination as claimed in claim 12, said hopper including an agitating rotor positioned generally above and spanning across said outlet.

15. A method of laying down granular materials on a roadway comprising:

attaching a dispensing hopper to the front of a motor grader;

attaching a screed to the moldboard of the motor grader;

loading materials from a supply vehicle into the hopper as the motor grader and the supply vehicle advance in concert along the roadway;

metering materials from the hopper onto the roadway ahead of the screed as the motor grader and the supply vehicle advance; and spreading metered materials into a layer of desired thickness with the screed as the loading and metering steps are being carried out.

16. A method as claimed in claim 15, including depositing materials on the roadway to a first width during said metering step and spreading the deposited materials out wider to a second width during said spreading step.

17. A method as claimed in claim 16, including putting a crown into the layer of materials during the spreading step.

* * * * *